US006263619B1

(12) United States Patent
Gretz

(10) Patent No.: US 6,263,619 B1
(45) Date of Patent: Jul. 24, 2001

(54) CATHEDRAL CEILING FIXTURE MOUNTING

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 0 days.

(21) Appl. No.: 09/653,999

(22) Filed: Sep. 2, 2000

(51) Int. Cl.[7] ..... G09F 7/18

(52) U.S. Cl. ..... 52/39; 52/27; 52/28; 248/343; 248/342; 248/317

(58) Field of Search ..... 52/39, 28, 27; 248/343, 342, 317; 174/48

(56) References Cited

U.S. PATENT DOCUMENTS 5,592,788 * 1/1997 Corridon ..... 52/39
5,916,094 * 6/1999 Gretz ..... 52/39
6,173,935 * 5/1999 Gretz ..... 248/343

* cited by examiner

*Primary Examiner*—Carl D. Friedman
*Assistant Examiner*—Chi Nguyen

(57) ABSTRACT

A three piece mounting device for attaching a fan or similar electrical fixture to a cathedral ceiling. The mounting device of the present invention comprises a rectangular box having an open top and an optionally enclosed bottom, and a pair of opposed extended side walls shaped to engage the center point of cathedral ceilings. The opposed extended side walls are inserted into slots or other mechanical engagement devices in opposing walls of the rectangular box, are of substantially uniform thickness throughout their height and incorporate a plurality of score lines to permit easy truncation of the opposed side walls to adapt to a plurality of ceiling angles.

The mounting device of the present invention may include an inverted integral electrical outlet box in the rectangular box. In such a case, the integral electrical box includes a center screw hole penetrating the close bottom and has its open end approximately coplanar with the outer surface of a closed bottom

8 Claims, 7 Drawing Sheets

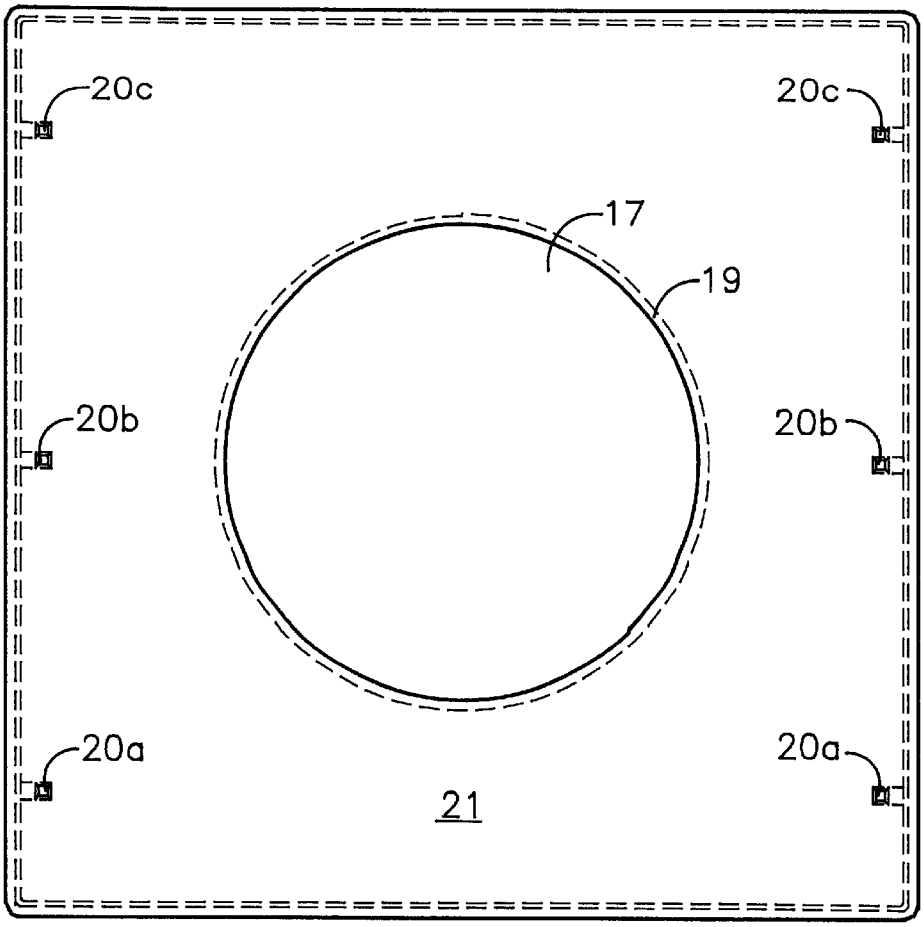
FIG. 3
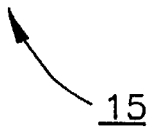
FIG. 8
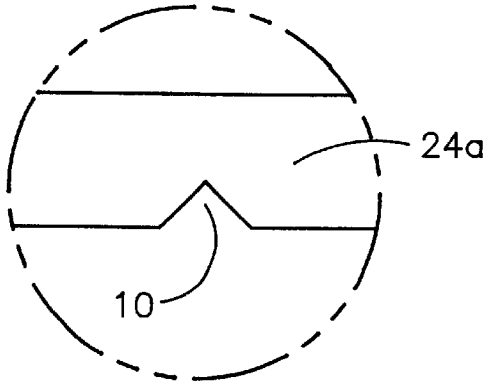

CATHEDRAL CEILING FIXTURE MOUNTING

FIELD OF THE INVENTION

The present invention relates to devices and methods for mounting ceiling fans and other large and heavy electrical fixtures to cathedral ceilings. More particularly, the present invention describes such a device and method for use principally in new construction.

BACKGROUND OF THE INVENTION

Mounting structures for electrical devices have met increasing demands for strength and stability with the advent and common installation of ceiling fans, particularly lighted such devices, and large chandeliers, especially when such mounting is in a cathedral ceiling or one having a significant pitch. While each of these electrical fixtures or devices has its own unique set of mounting problems, ceiling fans with their large heavy motors and often the addition of lighting devices, have posed a particular issue because of the large static loads which they represent when hung from a ceiling. Additionally, the fan rotation provides a dynamic load that also requires consideration when mounting such devices.

There have been numerous efforts in the prior art to provide adequate structure for the hanging or mounting of large electrical devices that represent large static and/or dynamic loads from cathedral and high-pitch ceilings.

U.S. Pat. No. 4,892,211 To Jorgensen describes a ceiling box for mounting and supporting a ceiling fan on a ceiling. The ceiling box includes a top wall portion with a side wall portion surrounding the periphery of the top wall portion. The box is open at the end opposite the top wall portion and the side wall portion has a pair of flanges extending normal thereto into the open end of the box. These flanges have holes in them for receiving fan-supporting screws. In a first embodiment, a pair of threaded mounting screw holes are formed in the top wall portion and are each axially aligned with an unthreaded hole that extends through the respective flange. In a second embodiment, the holes in the flanges are also threaded for added support.

U.S. Pat. No. 5,183,233 to LaPalomento, describes a support for hanging an electrical fixture from a ceiling or wall and a method for suspending the fixture. The support comprises a panel that is intended to be affixed to the grid work or frame of a house and a support affixed to the panel that holds the electrical fixture. A slot is provided on the rear of the panel to hold the panel flush against a flat surface and to allow electrical wiring to connect to the electrical fixture.

U.S. Pat. No. 5,234,119 to Jorgensen et al, describes a plastic ceiling box adapted to support a ceiling fan and designed to be mounted on a structural member, such as a ceiling joist. The ceiling box comprises a body member having a lower wall and a pair of sidewalls defining a recess for snugly receiving a ceiling joist. Box mounting holes for receiving box mounting fasteners are located at opposite sides and ends of the lower wall for attaching the ceiling box to the joist. Openings for receiving fan supporting fasteners are formed in the body member adjacent the box member and aid in attaching the body member to the joist. This overall arrangement provides sufficient support and strength to resist dynamic loads imposed by the ceiling fan even though the ceiling box is made of plastic.

U.S. Pat. No. 5,522,577 to Roesch describes a mounting assembly for supporting a ceiling fan that includes a support beam located inwardly of the ceiling surface a predetermined distance. An electrical box having a bottom wall is directly joined to and supported from the support beam. The box has sidewalls extending from the bottom wall through the ceiling substantially to the exposed ceiling surface and terminating in an open end. A rigid metal plate or disk member adapted for supporting and mounting a ceiling fan is positioned over the open end of the box. The disk member is of a size sufficient to have a peripheral portion extending radially beyond the side walls of the box and a plurality of mounting screws extend from the metal disk member through the interior of the box into connected engagement with the beam. The mounting screws support the disk member from the beam without reliance on the electrical box for support.

U.S. patent application Ser. No. 08/927,614 entitled "Ceiling Medallion Assembly" filed Sep. 11, 1997 in the name of Thomas J. Gretz describes a mounting assembly for holding an electrical device in place on a joist or stud. The assembly includes an electrical box having a planar base, preferably with three planar surfaces of different depths, a fastener device for temporarily securing an electrical box in place, a ceiling medallion for covering the electrical box, a second fastener device for temporarily securing the ceiling medallion to the electrical box and a fixation device for securely fastening the electrical box and a ceiling bezel to the joist or stud. The electrical box for mounting on the joist or stud includes: a generally rectangular housing with two opposite sides having a stepped appearance defining three different depths of the housing with a third side at a first shallow depth and a fourth side at a third deepest depth, a first back piece spanning the opposing sides at a first depth approximately equal to the thickness of the ceiling material, a second back piece spanning the opposites sides of the second depth that is greater than the first depth of the first back piece, the second depth being approximately equal to twice the thickness of the ceiling material and a third back piece spanning the opposite sides at a third depth that is greater than the second depth of the second back piece.

U.S. Pat. No. 5,592,788 to Corridon issued Jan. 14, 1997 describes a cathedral ceiling fixture mounting system comprising a fixture mount formed as a monolithic member or alternatively, with a bas mount member and one or more pitch mount members stacked sequentially, with each successive pitch mount varying the pitch of the fixture mount such that, when the pitch of the particular cathedral ceiling is known, the fixture mount is modified to correspond to the pitch of the ceiling.

Finally, U.S. Pat. No. 5,503,359 to Patterson, issued Apr. 2, 1996 describes a box assembly for mounting ceiling fans in cathedral or other ceilings with exposed rafters. The device consists of a formed or molded box intended for mounting between exposed rafters that includes mounting facilities for a ceiling fan. The device has provision for electrical wiring to be mounted above the device with the fan being located below the decorative box.

U.S. Pat. No. 5,916,094 To Gretz issued Jun. 29, 1999 describes a one piece, cathedral ceiling mounting block to be used in conjunction with a standard electrical box. The mounting block features a pair of opposed vertical walls that can be modified to conform to two different ceiling angles by the removal of one of two stacked flanges of different thickness that form the opposed vertical walls. While such an arrangement is adequate to accommodate two or three different adaptable angles, it requires much too thick an opposed vertical wall structure to accommodate more angle variation than this. Accordingly, it is unacceptable as a design for a mounting device that is suitable for adjustment to more than two or at most three such different angles.

Although the foregoing methods and apparatus have all attempted to solve the problem of adequately mounting the increased loads of electrical fixtures in cathedral or high pitch ceilings; none have provided an entirely adequate solution to this long standing problem. This is primarily because of the lack of adaptability of such mounting blocks to the virtually infinite number of ceiling pitches that can be encountered when installing such fixtures on cathedral ceilings.

SUMMARY OF THE INVENTION

According to the present invention, there is provided a three piece mounting device for attaching a fan or similar electrical fixture to a cathedral ceiling. The mounting device of the present invention comprises a rectangular box having an open top and an optionally enclosed bottom, and a pair of opposed extended side walls shaped to engage the center point of cathedral ceilings. The opposed extended side walls are inserted into slots or other mechanical engagement devices in opposing walls of the rectangular box, are of substantially uniform thickness throughout their height and incorporate a plurality of score lines to permit easy truncation of the opposed side walls to adapt to a plurality of ceiling angles.

The mounting device of the present invention may include an inverted integral electrical outlet box in the rectangular box. In such a case, the integral electrical box includes a center screw hole penetrating the closed bottom and has its open end approximately coplanar with the outer surface of the closed bottom.

DESCRIPTION OF THE DRAWINGS

FIG. 3 is a bottom view of the mounting device depicted in FIG. 1.

FIG. 8 is a detailed view showing a score line in the opposing side wall depicted in FIG. 7.

DETAILED DESCRIPTION OF THE INVENTION

Figure 1:
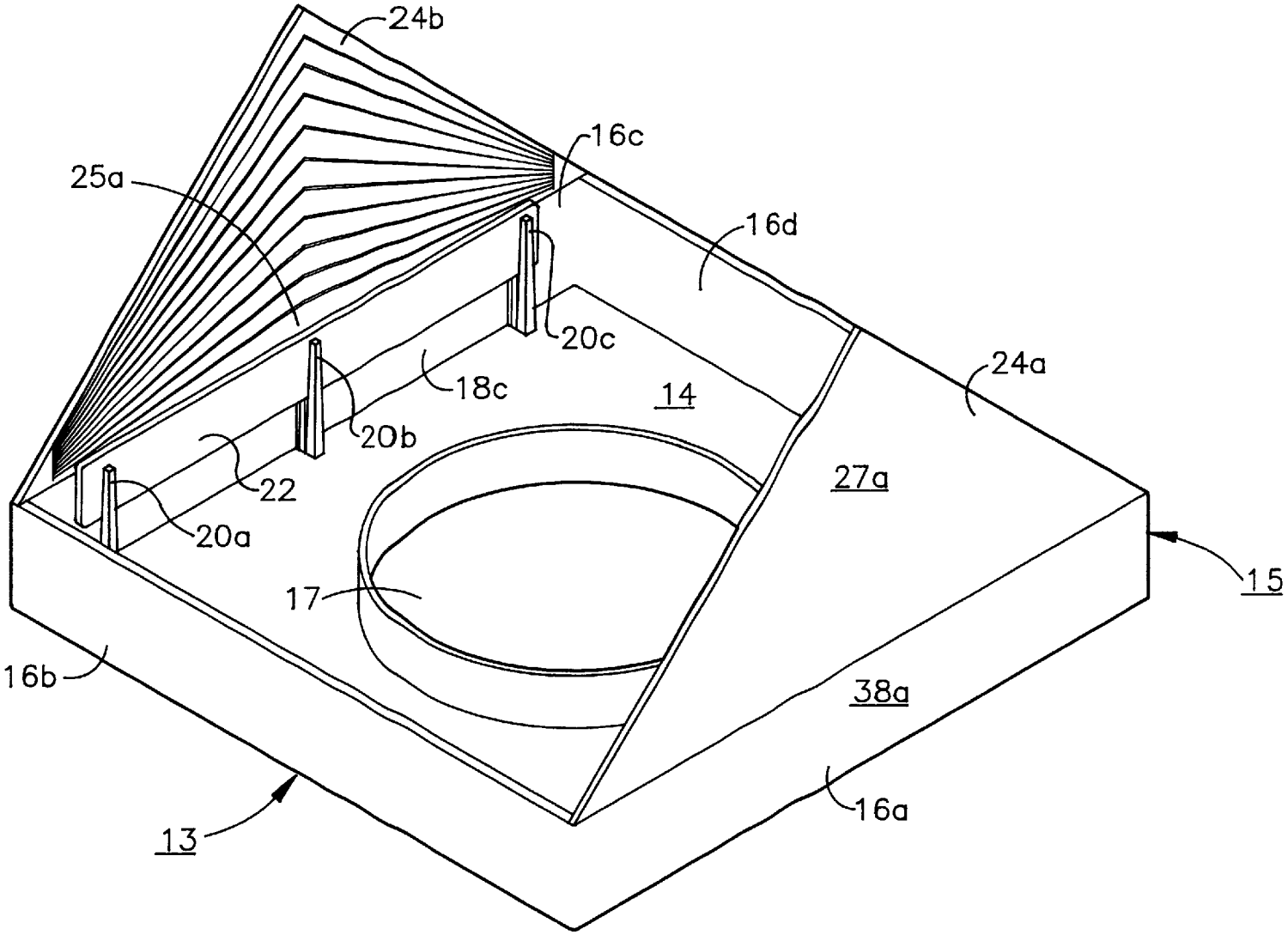
FIG. 1 is a perspective view of the mounting device of the present invention.

As shown in FIG. 1, the first embodiment of the mounting device 13 of the present invention comprises a generally rectangular box 15 having a bottom 14 that, according to the embodiment depicted in FIG. 1, includes an aperture 17 of a size to permit engagement with a standard electrical box (not shown) previously installed by mounting to an appropriate rafter or other structural member. Generally rectangular box 15 includes four walls 16*a*, 16*b*, 16*c*, and 16*d* of approximately equal height. Opposing walls 16*a* and 16*c* each include along their inner surface 18*c*, a plurality, at least two and preferably three, integrally formed brackets 20*a*, 20*b* and 20*c* that serve to frictionally engage a flange 22 at the base of each of end walls 24*a* and 24*b* as shown in FIG. 1 and as will be further described hereinafter. Each of end walls 24*a* and 24*b* include on their inner surfaces score lines designated 2–12 in attached FIGS. 1 and 6. Score lines 2–12 permit opposing end walls 24*a* and 24*b* to be altered to match virtually any pitch angle of a cathedral ceiling by the simple expedient of cutting or breaking both of end walls 24*a* and 24*b* along matching score lines. In this manner and according to a preferred embodiment, cathedral ceiling of various angles of from about 45° to about 9° or even less in increments set by the designer can be accommodated.

Figure 2:
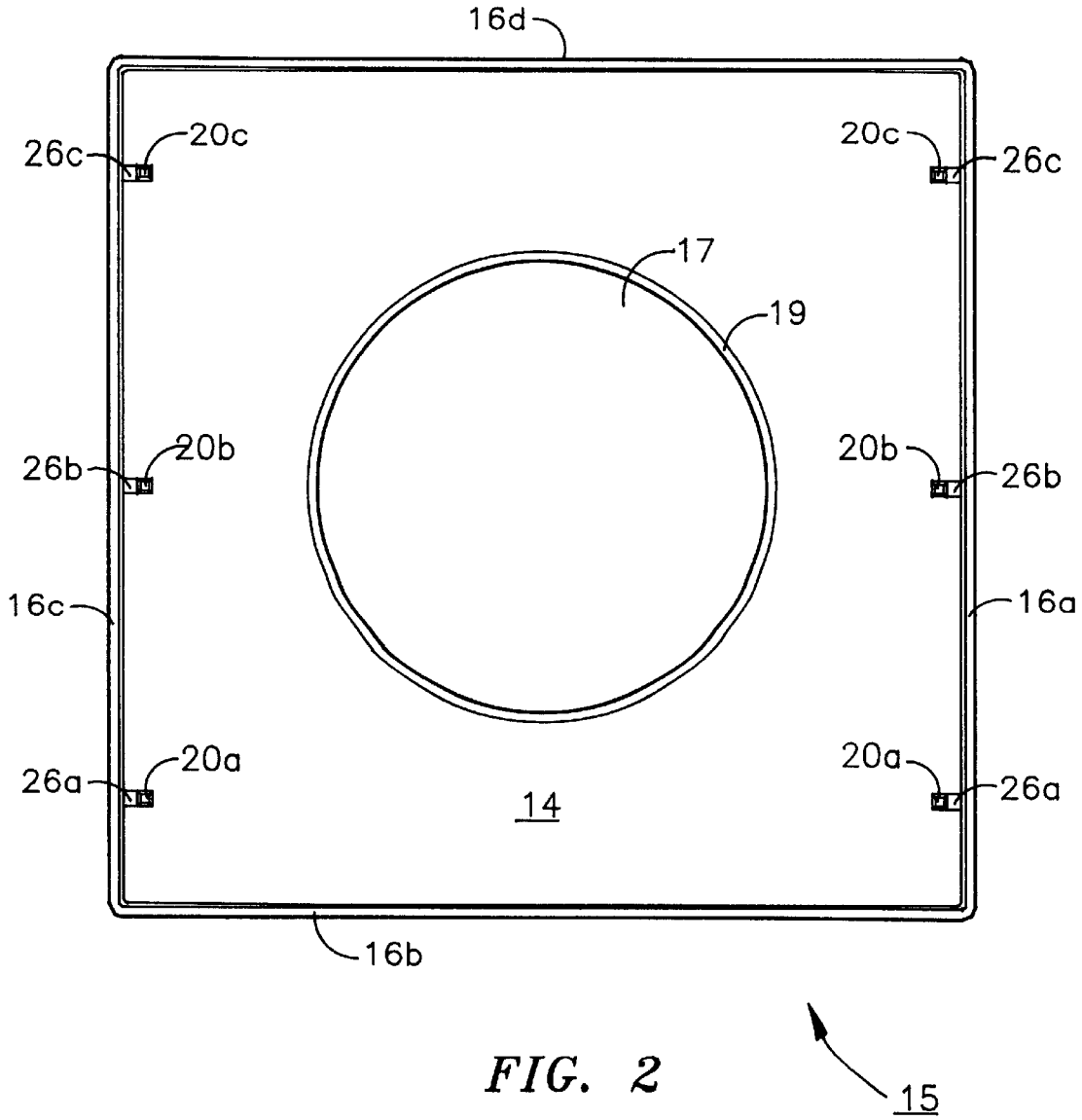
FIG. 2 is a top view of the mounting device depicted in FIG. 1.
Figure 5:
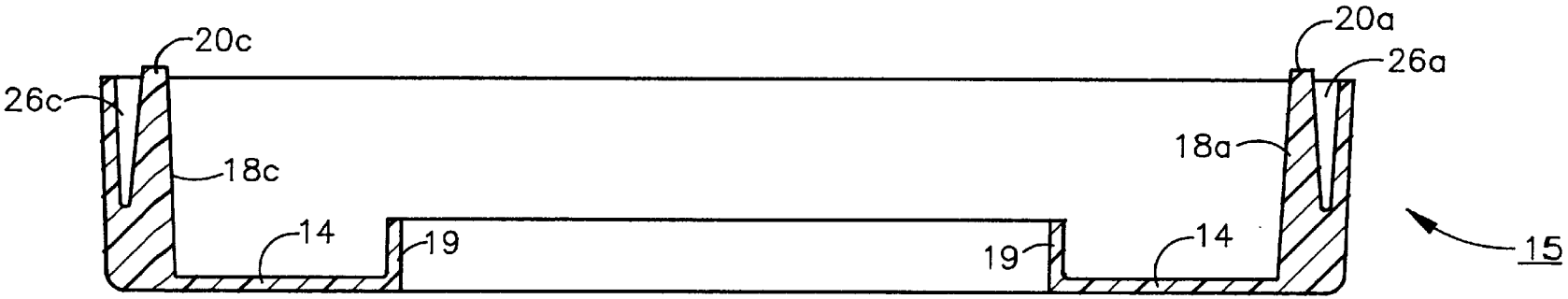
FIG. 5 is a cross-sectional view of the mounting device of the present invention along the line B—B of FIG. 1.

Referring now to FIGS. 2 and 3 that show the top and bottom views of rectangular box 15 respectively one can easily observe sides 16*a*, 16*b*, 16*c* and 16*d*, bottom 14 that includes aperture 17 that preferably includes peripheral stiffening flange 19 for fitting over a preinstalled electrical outlet box (not shown) as well as integrally formed brackets 20*a*, 20*b* and 20*c* integrally formed with opposing sides 16*a* and 16*c*. Slots 26*a*, 26*b* and 26*c* that lie between interior surfaces 18*a* and 18*c* of opposing walls 16*a* and 16*c* and serve to engage the lower flange portions 22*a* and 22*b* of end walls 24*a* and 24*b*, as described hereinafter, can also be observed, although these features are more clearly visible in FIG. 5. As will be apparent to the skilled artisan, brackets 20*a*, 20*b* and 20*c* can be replaced with a simple pair of such integral brackets or even a single longitudinal integral bracket that extends across the full or only a partial width of walls 16*a* and 16*c*. FIG. 3 shows the relatively planar bottom 21 of rectangular box 15.

Figure 6:
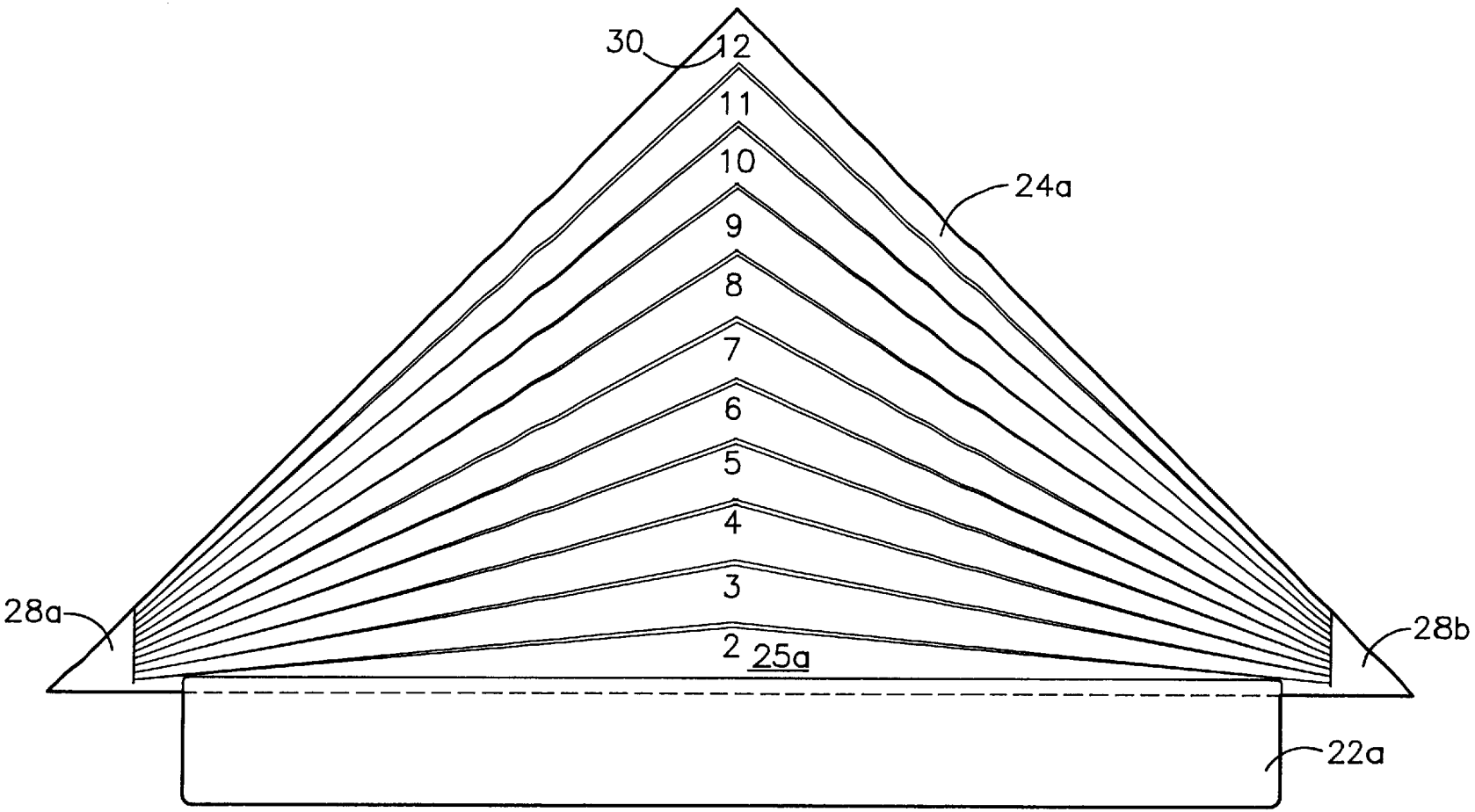
FIG. 6 is a rear view of one opposing extended side wall of the mounting device of the present invention.

Each of end walls 24*a* and 24*b* are identical and only extended end wall 24*a* is depicted in the drawings. As shown in FIG. 6, extended end wall 24*a* comprises a generally triangular shape having a lower flange portion 22*a* integrally formed therewith and includes a series of score marks numbered 2–12 that initiate at lower corners 28*a* and 28*b* and rise in a straight line toward the apex 30 of extended end wall 24*a*. Although not critical to the successful practice of the present invention, it is highly preferred that score lines 2–12 in whatever their number be somehow individually identified by numbers as shown in FIGS. 1 and 6 or with alpha or other characters so that when broken or cut along score lines 2–12 on opposing end walls 24*a* and 24*b* they are indeed cut or broken along the same score one to provide the same angle on both elements. Quite obviously, if both end walls 24*a* and 24*b* are not identically cut, when finally assembled, mounting device 13 will not provide a proper fit against a properly evenly pitched ceiling.

Figure 7:
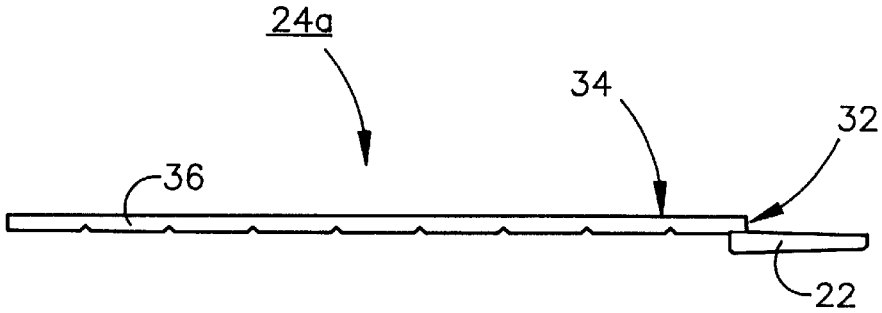
FIG. 7 is a side view of the opposing extended side wall of FIG. 6 along its vertical centerline.
Figure 4:
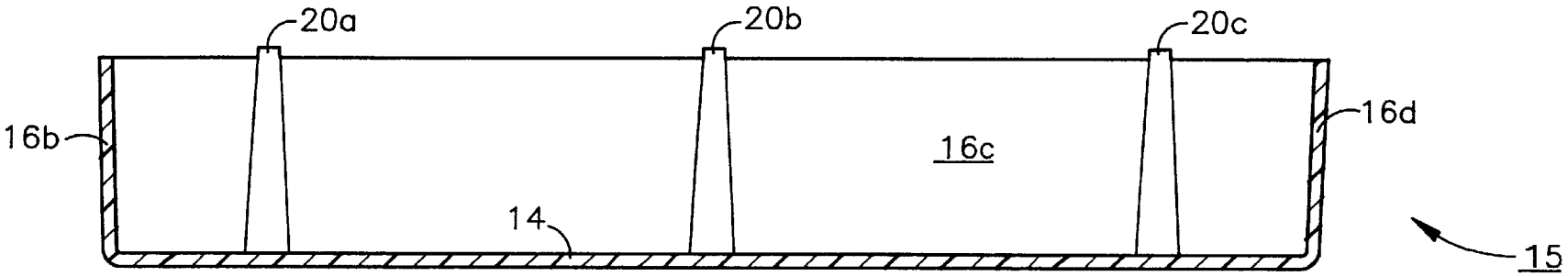
FIG. 4 is a cross-sectional view of the mounting device depicted in FIG. 1 along the line A—A of FIG. 1.

The shape of lower flange 22 a of extended end wall 24*a*, best shown in FIG. 7, is sized and shaped to frictionally engage slots 26*a*, 26*b* and 26*c* that lie between flanges 20*a*, 20*b* and 20*c* and the interior surface 18*a* of side wall 16*a* of rectangular box 15. Lower flange 22*a* is preferably wedge-shaped to engage wedge-shaped slots 26*a*, 26*b* and 26*c* and offset at point 32 as shown in FIG. 7 such that when lower flange 22*a* engages slots 26*a*, 26*b* and 26*c* outer surface 34 of upper portion 36 of extended end wall 24*a* lies approximately flush with outer surface 38*a* of side wall 16*a* thereby presenting a more aesthetically pleasing and uniform surface appearance. As will be apparent to the skilled artisan, lower flange 22 could be replaced with a pair or a plurality of individual lower flanges that engaged individual slots 26*a*, 26*b* and 26*c* and such a modification is clearly contemplated as within the scope of the appended claims.

As shown in FIG. 8, score lines 2–12 need penetrate only about one tenth or less of the depth of upper portion 36 to be effective, although the such depth is largely a matter of design choice. As best shown in FIG. 1, while the back or rear sides 25*a*, i.e. those sides facing the interior of rectangular box 15, of end walls 24*a* and 24*b* are scored as just described, for aesthetic reasons it is preferred that the front sides 27*a*, i.e. those sides facing away from the interior of rectangular box 15, of end walls 24*a* and 24*b* be smooth or receive a decorative surface treatment.

Figure 9:
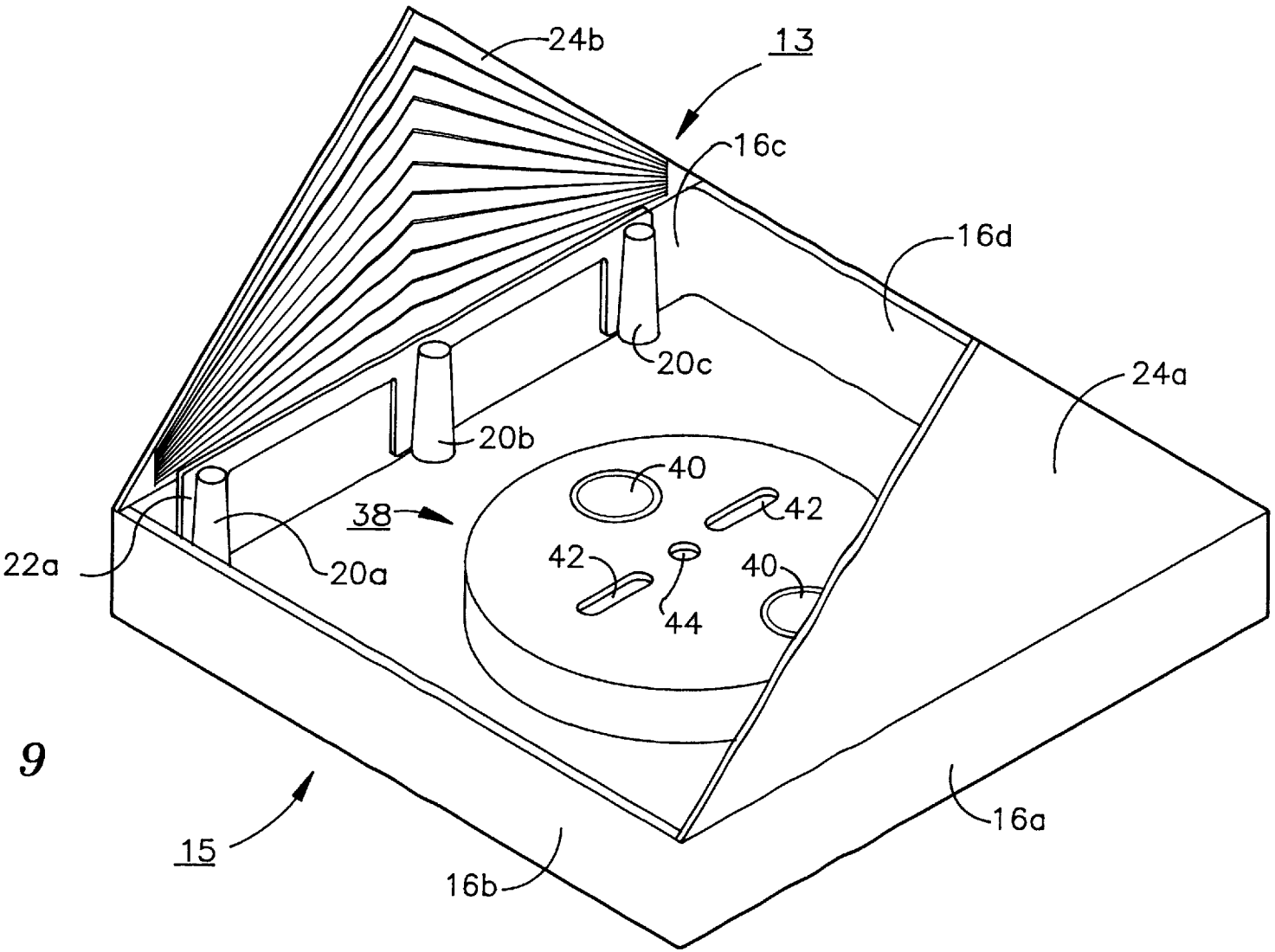
FIG. 9 is a perspective view of an alternative preferred embodiment of the mounting device of the present invention.

An alternative configuration for rectangular box 15 specifically designed for retrofit installations where no preexisting electrical junction box has been installed for the mounting of an electric fan or similar electrical fixture is shown in FIG. 9. As shown in this Figure, according to this embodiment, mounting device 13 in addition to the elements previously described also includes an integral inverted electrical junction box 38 that includes knockouts 40 to provide access to the interior for cable and wiring as well as slots 42 for insertion of bolts to secure a subsequently installed fan or other electrical fixture to mounting device 13. The opening of electrical junction box 38 is approximately coplanar with surface 21 of rectangular box 15. Additionally, electrical junction box 38 includes a central hole 44 in its base for insertion of a screw (not shown) to secure mounting device 13 to an overhead rafter or other structural member. Electrical junction box 38 preferably is of about the same height as walls 16*a*, 16*b*, 16*c* and 16*d* to assure proper fit in installations on low angle ceilings. In the embodiment depicted n FIG. 9, end walls 24*a* and 24*b* have three discrete lower flanges 22*a*, 22*b* and 22*c* as shown in FIG. 10 and described hereinafter, and flanges 20*a*, 20*b* and 20*c* are round rather than flat as depicted in the earlier figures.

In use, opposing end walls 24*a* and 24*b* are cut or broken along matching pairs of score lines 2–12 to match the pitch of the cathedral ceiling onto which mounting device 13 is to be attached and the lower flanges 22*a* and 22*b* of end walls 24*a* and 24*b* inserted into slots 26*a*, 26*b* and 26*c* of walls 16*a* and 16*c* and pushed downward to assure proper frictional engagement. Mounting device 13 is then in condition for installation in accordance with conventional techniques.

Figure 10:
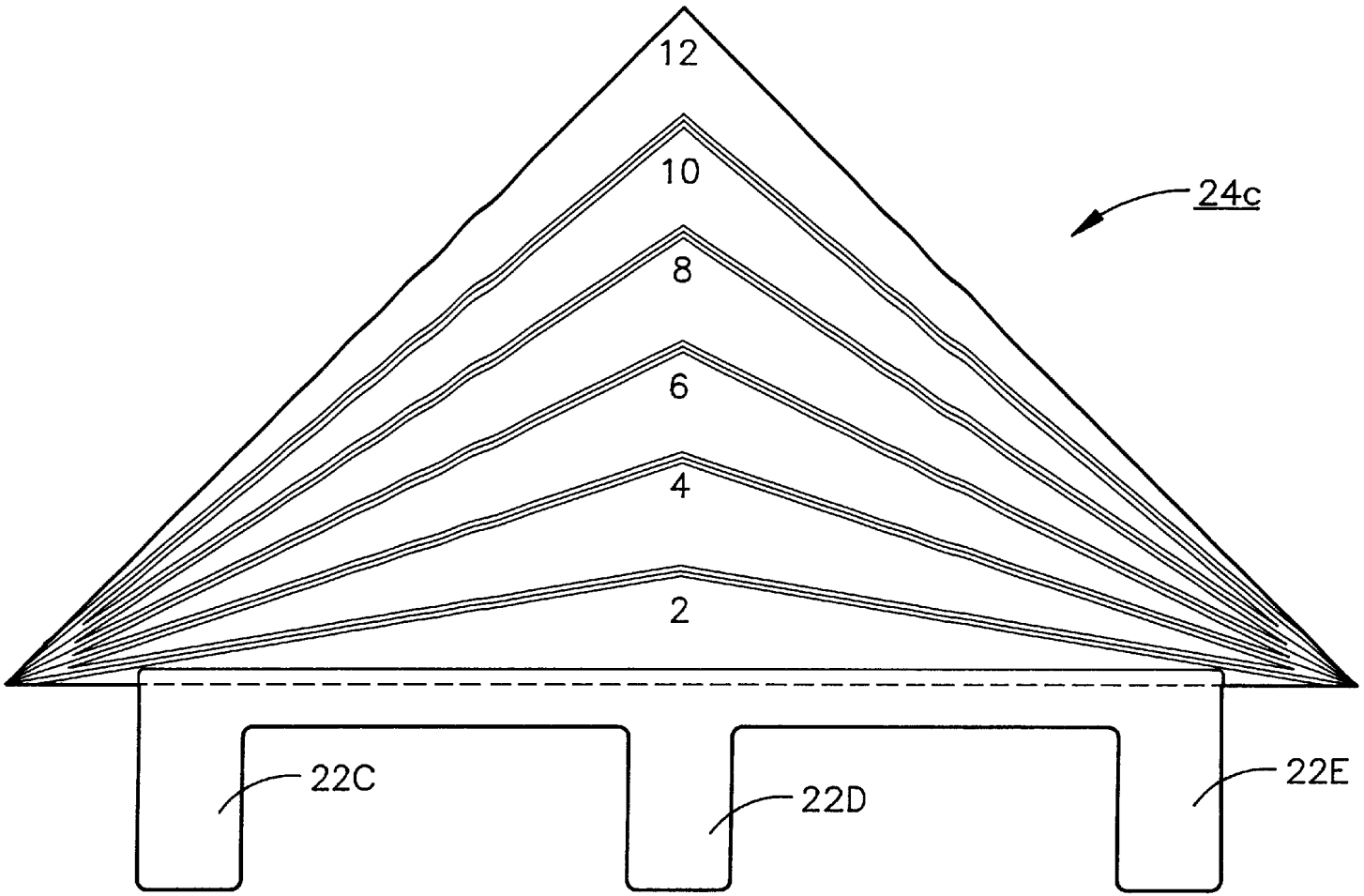
FIG. 10 is an inside or back side view of an alternative preferred embodiment of the opposing end walls of the mounting device of the present invention.

Referring now to FIG. 10, end walls 24*a* and 24*b* may have an alternative configuration as depicted as end wall 24*c* in this Figure. According to this embodiment, end wall 24*c* is of the same general triangular configuration as end wall 24*a* depicted in FIG. 6 but has only one half the number of score lines designated as 2, 4, 6, 8, 10, and 12 in FIG. 10. Additionally, end wall 24*c* has three discrete lower flanges 22*c*, 22*d* and 22*e* that individually engage slots 26*a* and 26*c* shown in FIG. 5. This configuration of end wall 24*c* permits reduction in the amount of material used to manufacture the mounting device of the present invention with no decrease in either its utility or strength.

Mounting device 13 may of course be manufactured from any suitable material and in any suitable fashion, however, it is preferred that it be injection molded from an appropriate plastic material such as polyvinyl chloride for cost and electrical insulation reasons.

As the invention has been described, it will be apparent to those skilled in the art that the same may be varied in any ways without departing from the spirit and scope of the invention. Any and all such modifications are intended to be within the scope of the appended claims.

What is claimed is:

1. A mounting device for attaching an electrical fixture to a cathedral ceiling comprising:

A) a generally rectangular box having:
- i) an open top;
- ii) a bottom incorporating a central aperture;
- iii) four walls having interior and exterior surfaces two of which walls are opposing and incorporate at least one integral bracket that provides at least one slot between the opposing interior surface and the integral bracket; and B) a pair of generally triangular end walls comprising:
- i) a base having opposed lower extremities and interior and exterior surfaces;
- ii) an apex;
- iii) at least one longitudinal flange extending from said base; and
- iv) a plurality of score lines extending from each of said opposed lower extremities toward said apex at a plurality of matching but varying angles;

each of said pair of generally triangular end walls being attachable to said rectangular box by insertion of said at least one longitudinal flanges into said at least one slots.

2. The mounting device of claim 1 further including an inverted electrical junction box installed over said central aperture.

3. The mounting device of claim 1 further including visible identifiers for said matching score lines.

4. The mounting device of claim 1 wherein said at least one slot and said at least one flange are wedge-shaped.

5. The mounting device of claim 1 including a single longitudinal flange on each of said end walls and three brackets that provide three slots.

6. The mounting device of claim 1 wherein said at least one flange is offset such that when said at least one flange is inserted into said at least one slot the exterior surface of said end wall is flush with the exterior surface of said opposing walls.

7. A mounting device for attaching an electrical fixture to a cathedral ceiling comprising:

A) a generally rectangular box having:
- i) an open top;
- ii) a bottom incorporating a central aperture;
- iii) four walls having interior and exterior surfaces two of which walls are opposing and incorporate three brackets that provide at least one slot between the opposing interior surface and the integral brackets; and B) a pair of generally triangular end walls comprising:
- iv) a base having opposed lower extremities and interior and exterior surfaces;
- v) an apex;
- vi) a longitudinal flange extending from said base; and
- vii) a plurality of score lines extending from each of said opposed lower extremities toward said apex at a plurality of matching but varying angles;

each of said pair of generally triangular end walls being attachable to said rectangular box by insertion of said longitudinal flange into said slots.

8. The mounting device of claim 1 wherein each of said generally triangular end walls has three longitudinal flanges that engage three slots.

* * * * *